US006270256B1

(12) United States Patent
Todman

(10) Patent No.: US 6,270,256 B1
(45) **Date of Patent: *Aug. 7, 2001**

(54) TAMPER EVIDENT BAG

(75) Inventor: Victor Todman, Impington (GB)

(73) Assignee: Sealed Air Corporation, Saddle Brook, NJ (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/999,179

(22) Filed: Dec. 29, 1997

(30) Foreign Application Priority Data

Apr. 7, 1997 (GB) ..... 9714228

(51) Int. Cl.[7] ..... B65D 33/34
(52) U.S. Cl. ..... 383/5; 383/84
(58) Field of Search ..... 383/5, 84, 89; 229/80, 83

(56) References Cited

U.S. PATENT DOCUMENTS

| | | | | |
|---|---|---|---|---|
| 1,201,519 | * | 10/1916 | Sorensen | 229/80 |
| 1,928,180 | * | 9/1933 | Leas | 229/83 X |
| 2,088,068 | * | 7/1937 | Overbaugh | 229/83 |
| 2,181,252 | * | 11/1939 | Vogel | 229/80 |
| 2,249,867 | * | 7/1941 | Snelling | 229/83 |
| 2,457,809 | * | 1/1949 | Drummond | 229/83 X |
| 3,895,755 | * | 7/1975 | McCarthy | 229/83 |
| 4,457,430 | | 7/1984 | Darling et al. . | |
| 4,838,708 | * | 6/1989 | Holcomb et al. | 383/5 |
| 4,937,040 | * | 6/1990 | Holcomb et al. | 383/5 |
| 5,077,001 | * | 12/1991 | Makowka | 383/5 |
| 5,108,194 | * | 4/1992 | Raden | 383/5 |
| 5,352,041 | * | 10/1994 | Fullerton et al. | 383/5 |
| 5,405,197 | * | 4/1995 | Makowka | 229/80 X |

FOREIGN PATENT DOCUMENTS

| | | | | |
|---|---|---|---|---|
| 3342256 | * | 6/1985 | (DE) | 383/5 |
| 0 105 581 | | 8/1983 | (EP) . | |
| 0 373 748 | | 9/1986 | (EP) . | |
| 0259068 | * | 3/1988 | (EP) | 229/80 |
| 0 403 532 B2 | | 3/1989 | (EP) . | |
| 0 493 465 B1 | | 9/1990 | (EP) . | |
| 0396428 | * | 11/1990 | (EP) | 383/5 |
| 0 491 099 B1 | | 12/1990 | (EP) . | |
| 0 515 086 B1 | | 5/1992 | (EP) . | |
| 1536784 | * | 12/1978 | (GB) | 383/78 |
| 2138396 | * | 10/1984 | (GB) | 383/5 |
| 2202823 | * | 10/1988 | (GB) | 383/5 |
| 9115406 | * | 10/1991 | (WO) | 383/5 |
| 9300269 | * | 1/1993 | (WO) | 383/5 |
| WO 93/16933 | | 9/1993 | (WO) . | |
| WO 96/04177 | | 2/1996 | (WO) . | |

* cited by examiner

*Primary Examiner*—Jes F. Pascua
(74) *Attorney, Agent, or Firm*—Mark B. Quatt

(57) ABSTRACT

A tamper evident bag comprises a slit therein to provide access to the interior of the bag, and a closure flap arranged to be adhered to the bag over the slit in order to seal the bag. The bag has an indicator strip which is covered by the closure flap when the bag is sealed. This indicator strip comprises a material having a surface tension less than or substantially equal to that of saliva and serves to indicate wetting of the bag or closure flap prior to attempted sealing.

3 Claims, 3 Drawing Sheets

TAMPER EVIDENT BAG

FIELD OF THE INVENTION

This invention relates to bags formed of sheet material and, more particularly, to a tamper evident bag which is a security bag exhibiting a visible indication if an unauthorised attempt is made to gain access to the interior of the bag.

BACKGROUND OF THE INVENTION

It is known, for example, in financial institutions to use such bags to transfer sums of money between departments-A variety of different tamper evident bag designs are available, including that disclosed in EP-A-0 396 428, as illustrated in FIG. 1 of the accompanying drawings and described in detail below.

A problem which arises with such bags is that the adhesive used on the tamper evident closure portion, which is used to close the bag and seal the access opening, fails to work adequately, if wetted, and the bag can be opened without visibly affecting the tamper evident closure portion.

The surface tension of all presently available substances which are used in pressure sensitive tamper evident closures, to seal such bags, is approximately 32 Dynes $cm^1$. Therefore, the wetting of the closure with water, which has a surface tension of approximately 70 Dynes $cm^1$ and a low viscosity, is not an insurmountable problem. This is because the majority of the water used will be ejected by the action of pressing the closure to the bag. Also, due to its higher surface tension the water which is left will form droplets instead of smearing along the length of the closure, and will only cause localised failure of the seal. However, saliva, which has a surface tension of approximately 30–32 Dynes $cm^1$ and a much higher viscosity than water, will not be ejected by the action of the closure and will smear over the latter thus preventing adequate sealing of the bag.

Therefore, presently available tamper evident bags have the disadvantage that someone can pretend to seal the bag, but lick it beforehand, thus preventing sealing of the bag and enabling unauthorised access to the interior thereof.

It is an object of the present invention to address the aforementioned disadvantage of presently available tamper evident bags.

One apparent solution to this problem is to form a bag from a material with a reduced effective surface tension such that saliva will not smear on the bag and will not cause failure of the seal along its entire length. However, as discussed above the lowest possible surface tension of the material used on the closure to seal the bag is approximately 32 Dynes $cm^1$. Therefore, the closure will act as a medium to smear the saliva, when pressed against the bag, and will thus prevent complete closure and sealing of the bag.

SUMMARY IF THE INVENTION

A solution is provided by the present invention, according to which there is provided a bag formed of sheet material and having an opening to enable access to the interior of the bag, a closure portion positionable over the opening, adhesive for securing the closure portion to the bag in order to seal the opening when the closure portion is positioned over the opening, and indicator means disposed between the closure portion and the bag when the closure portion is positioned over the opening and adapted to indicate wetting of the bag or closure portion upon attempted sealing of the opening.

Conveniently, the bag is formed from plastics sheet material which is folded to form first and second superposed portions which are sealed together along their free edges to form an envelope-like bag. The access opening may be disposed in the first portion and the closure portion may comprise a flap portion which is integral with or fixed to the sheet material of the bag. For example, the flap portion may be integral with the second portion of the sheet material of the bag so as to be foldable over the access opening. Alternatively, the closure or flap portion may be fixed to the first portion adjacent the access opening. It may be fixed to the sheet material of the bag by adhesive or heat welding. The adhesive for securing the closure portion to the bag may be in the form of a band of adhesive applied to the closure portion. Conveniently, a releasable cover strip is provided on the free surface of the band of adhesive.

The closure portion is preferably transparent or translucent and the indicator means is applied to the bag.

Preferably, the indicator means comprises a material having a surface tension less than or substantially equal to that of saliva. It may comprise a dye and a carrier material in which the dye is dissolved or otherwise supported.

The indicator means may present a coherent image on either the bag or on the closure strip which is disrupted by wetting. A message such as "open" or "tampered" may be printed on the bag, the message being hidden by the indicator means when not wetted and being revealed when the indicator means is wetted. Conveniently, the message and indicator means are both disposed on the bag. Alternatively, the message may be printed on the bag and the indicator means provided on the closure portion.

BRIEF DESCRIPTION OF THE DRAWING

Embodiments of the present invention will now be described, by way of example, with reference to the accompanying drawings, in which:

Referring to FIGS. 1 and 2 of the accompanying drawings, the prior art bag is formed from a single strip 1 of flexible thermoplastics sheet material, such as, polyethylene or polypropylene, which is folded laterally along a fold line 2 to form a first portion 3 and a second portion 4. The thermoplastics sheet material is preferably transparent, partially transparent or translucent, or a combination of opaque and transparent so as to make it easier to see the evidence of tampering. The folded portions 3 and 4 are heat welded to each other in a zone 5 which extends parallel with and close to each of the longitudinal and each of the lateral edges of the portions to produce an envelope-like bag 6 wherein the second portion 4 is longer than the first portion 3 and has a part in the form of a flap portion 7 which forms a closure.

Figure 1:
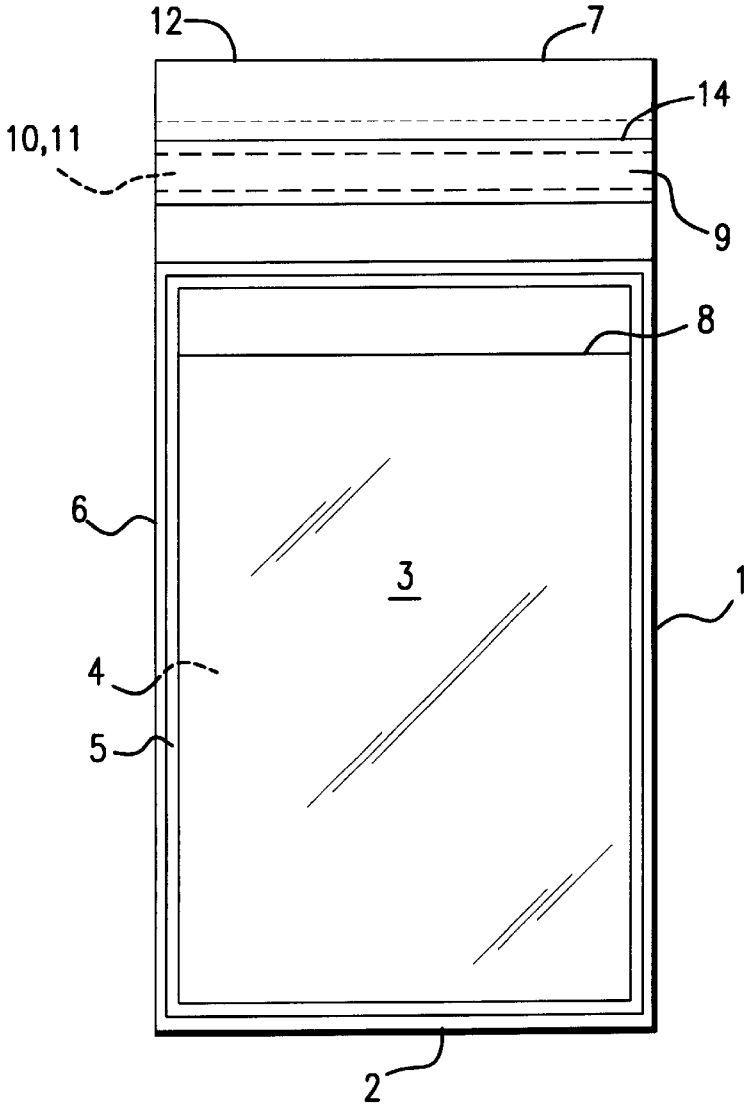
FIG.1 PRIOR ART
FIG. 1 is a diagrammatic plan view of an open tamper evident bag of the type described in EP-A-0 396 428.
Figure 2:
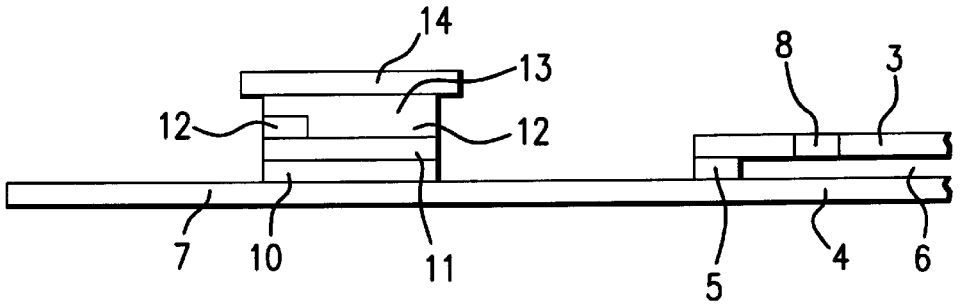
FIG.2 PRIOR ART
FIG. 2 is a diagrammatic sectional view through the part of the bag of FIG. 1 adjacent its access opening.

At an end region of the bag 6 closer to the flap portion 7 an opening line in the form of a slit 8 extends across the first portion 3 terminating at each end at the weld zone 5. The slit 8 provides access to the interior of the bag 6. A tape 9 extends across the full width of a part of the flap portion 7 (which has preferably been subjected to corona discharge) and is adhered thereto by a band of high tack adhesive 10 which may optionally have a surface provided with a security code by means of an ink jet printing technique.

High tack adhesive is intended to mean a highly sticky pressure sensitive adhesive giving high initial adhesion under minimal application pressure. For example, the adhesive may be a hot melt pressure sensitive adhesive, such as, Fullers DS 5762.

The tape comprises a transparent or translucent substrate portion 11 having a first surface constituting a free face of the tape and a second surface coated with discrete areas 12 of release agent and then overcoated with a band of an opacified adhesive 13 comprising a solvent based acrylic adhesive and titanium dioxide. The free surface of the adhesive constitutes another free face of the tape and is preferably provided with a security code by an ink jet printing technique before being covered by a releasable cover strip 14. The opacified adhesive 13 is differentially bonded to the transparent substrate portion 11 in that those areas applied to the release agent 12 are much more weakly bonded than are those areas applied directly to the substrate portion 11. The first surface of the substrate 11 is bonded to the flap portion 7 by the high tack adhesive 10.

In use of the security bag, the items to be held in the bag are introduced into the bag 6 through the slit 8, the cover strip 14 is removed from the tape 9 and the flap portion 7 is folded over onto the portion 3 with the fold line being close to the adjacent laterally extending part of the weld zone 5. The disposition of the tape 9 relative to the fold line of the flap portion 7 is such that when the flap portion 7 is brought down onto the portion 3, the part of the flap portion 7 carrying the tape straddles the slit 8 so that the slit 8 is completely overlain by said part and the tape. Thus, as well as the flap portion 7 being bonded to the portion 3 by the opacified adhesive 13, the slit 8 is completely sealed and there is no access opening whatsoever to the interior of the bag 6. The parts of portion 3 adjacent the slit 8 have previously been subjected to corona discharge to assist adhesion.

Attempts to separate the flap portion 7 and the first portion 3 will ordinarily result in the opacified adhesive 13 separating from the substrate portion 11 in the weakly bonded areas with the more strongly bonded areas of the opacified adhesive 13 remaining adhered to the substrate portion 11 and thereby constituting a clearly visible pattern on the substrate. This pattern will not be obliterated even if attempts are made to reseal the bag by superposing flap portion 7 and the first portion 3 again. If someone attempting to open the bag should, in fact, succeed in lifting the flap portion 7 away from the substrate portion 11 by tampering with the high tack thermoplastic adhesive 10, the tape 9 will still remain in place over the opening 8 and any further attempts at opening the bag will immediately become evident by differential separation of the adhesive from the substrate portion 11, as described above.

However, as discussed above, if the tape 9 or portion 3 of the bag adjacent the slit 8 is wetted prior to closure the adhesive will fail to seal properly and the tamper evident effect of the tape 9 will be nullified. The wetting will also not be apparent.

Figure 3:
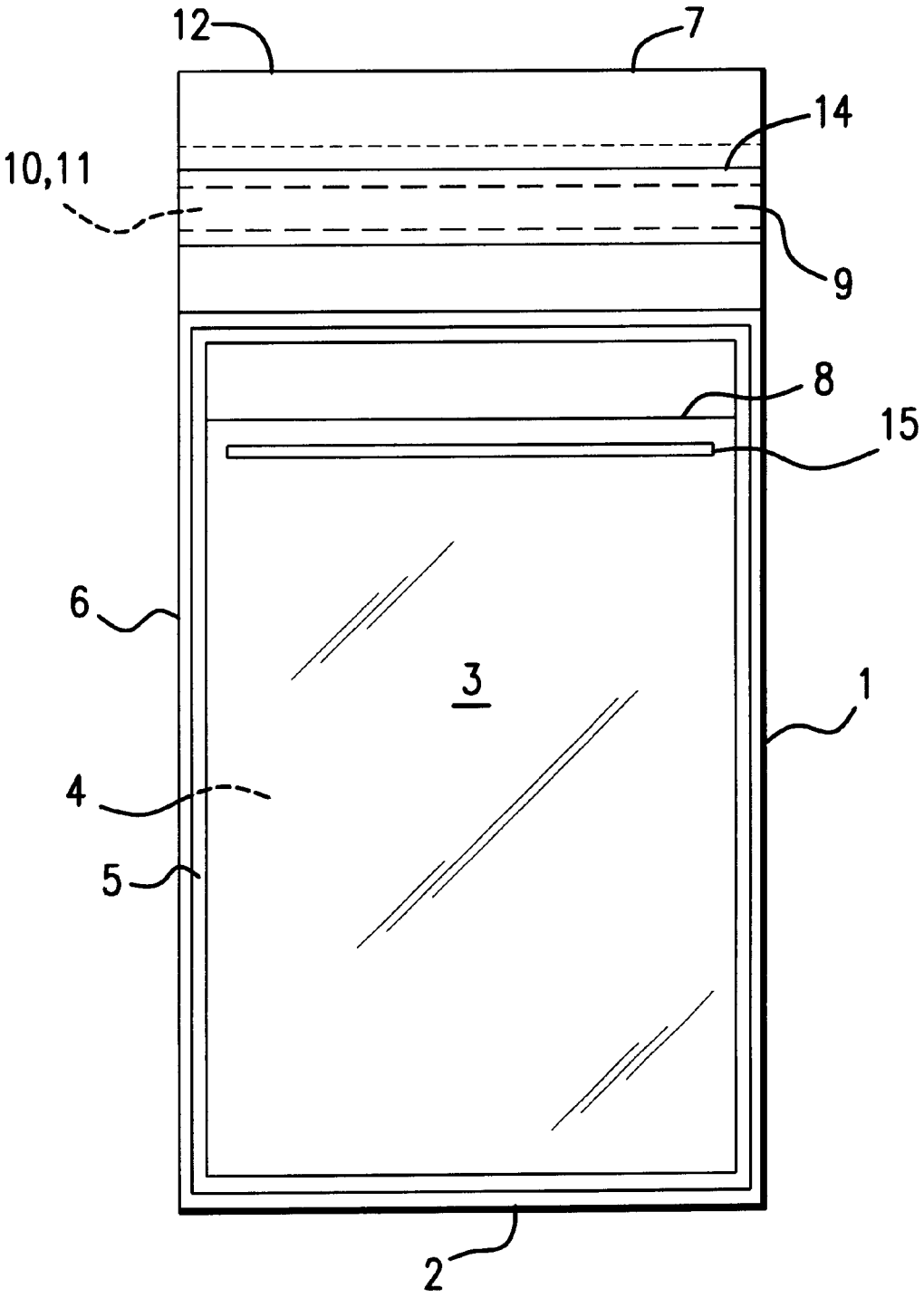
FIG. 3 is a diagrammatic plan view of the bag of FIG. 1 embodying the present invention.
Figure 4:
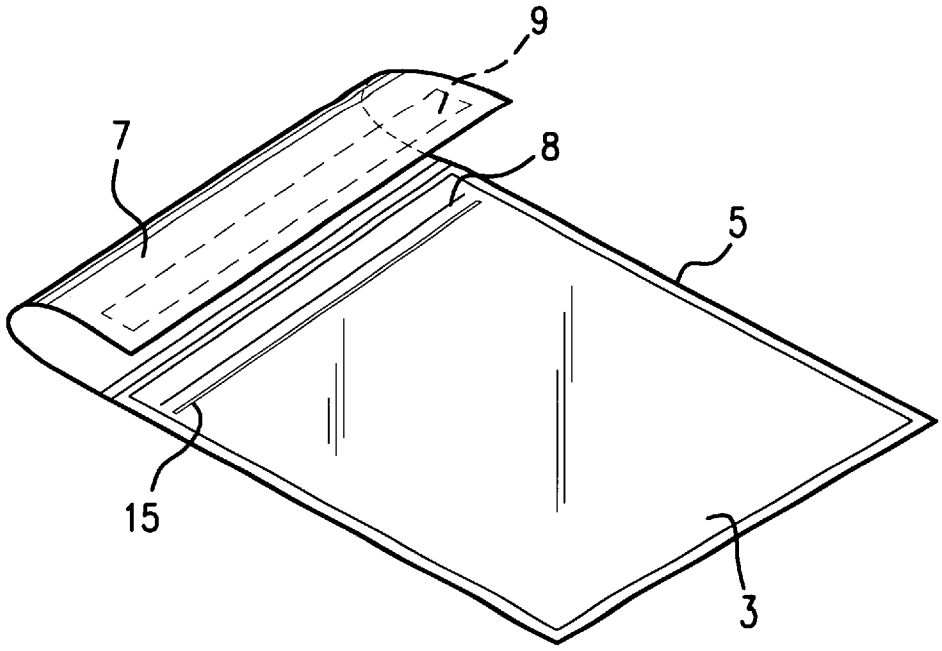
FIG. 4 is a perspective view of the bag of FIG. 3.

FIGS. 3 and 4 illustrate a bag, substantially as described with reference to FIG. 1, adapted to indicate wetting, by the inclusion of an indication strip 15 which runs the length of the slit a and is provided on the portion 3 of the bag adjacent thereto. The indication strip is formed from polyvinyl alcohol resin with a green dye impregnated therein. Polyvinyl alcohol resin has a surface tension less than that of saliva.

When the bag is closed properly, without wetting, the tape 9 will cover both the slit 8 and the indication strip 15. The adhesive 10 will not dissolve or smear or in any other way degrade or disrupt the strip 15. However, if either the tape 9 or the portion 3 of the bag, adjacent the slit 8, is wetted prior to closure then the indication strip 15 will be disrupted, either being smeared or removed totally, thus indicating attempted fraudulent closure of the bag without properly sealing it.

Figure 5:
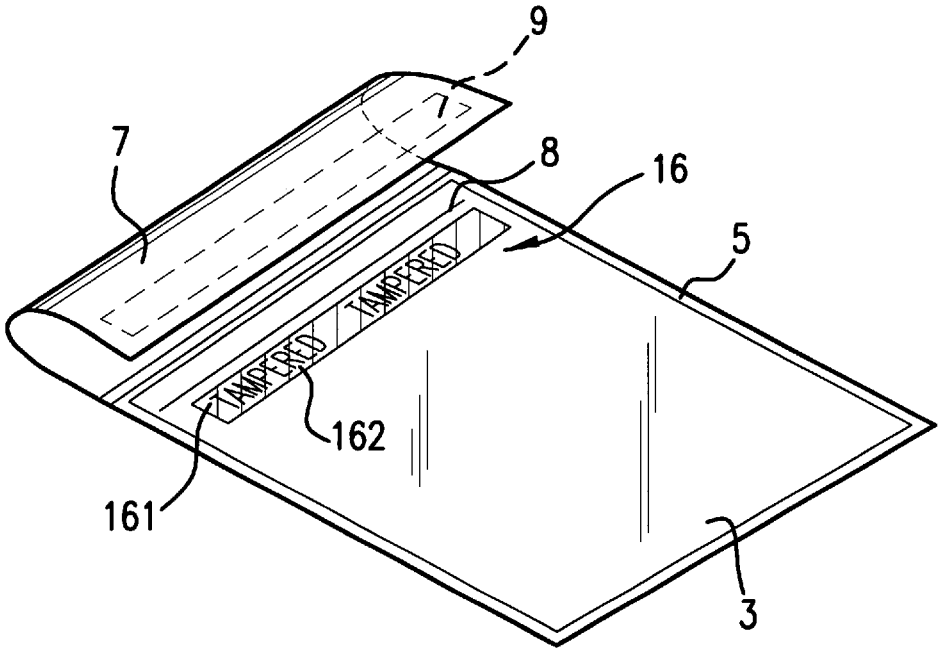
FIG. 5 is a perspective view of a second embodiment of the present invention.

FIG. 5 shows an alternative indication strip 16 comprising the printing of the word "tampered" repeatedly along the length of the slit 8 on the portion 3 of the bag, adjacent the slit. This printed section 161 being covered by a strip 162 of polyvinyl alcohol resin with green dye impregnated therein.

If the bag is closed correctly, as discussed above, the dye impregnated polyvinyl alcohol resin strip 162 will not be adversely affected However, if either the tape 9 or the bag adjacent the slit 8 is wetted prior to closure the strip 162 will be bled away to reveal the message "tampered".

Modifications may be made without departing from the scope of the present invention as defined by the appended claims. For example, in the embodiments of the invention as described in FIGS. 3, 4 and 5 the strip 15 or 162, may be placed on either the portion 3 of the bag or on the tape 9. In the second embodiment, if the strip 162 is placed on the tape 9 then the printed words 161, "tampered", may be replaced by the words "open", as this printing will be visible until the bag is sealed properly. Also, alternative materials may be used instead of polyvinyl alcohol.

What is claimed is:

1. A bag formed of sheet material and having an opening to enable access to the interior of the bag, a closure portion for closing said opening, adhesive for securing said closure portion to said bag in order to seal said opening, said adhesive being applied to one of the closure portion and the bag, and said adhesive and the other of the closure portion and the bag having mutually opposing surfaces which are adhered together to seal said opening when said closure portion is positioned for closing said opening, and indicator material applied to one of said opposing surfaces, said indicator material being adapted to indicate wetting of as least one of said opposing surfaces with saliva upon attempted sealing of the opening;

wherein said indicator material comprises a dye and a carrier material in which said dye is supported, wherein a message is printed on said one of said opposing surfaces, said message being hidden by said indicator material when not wetted and being revealed when said indicator material is wetted.

2. The bag of claim 1, wherein said adhesive is applied to said closure portion and said message and indicator material are applied to said opposing surface of said bag.

3. A bag formed of sheet material and having an opening to enable access to the interior of the bag, a closure portion for closing said opening, adhesive for securing said closure portion to said bag in order to seal said opening, said adhesive being applied to one of the closure portion and the bag, and said adhesive and the other of the closure portion and the bag having mutually opposing surfaces which are adhered together to seal said opening when said closure portion is positioned for closing said opening, and indicator material applied to one of said opposing surfaces, said indicator material being adapted to indicate wetting of as least one of said opposing surfaces with saliva upon attempted sealing of the opening;

wherein said indicator material comprises a dye and a carrier material in which said dye is supported, and wherein said adhesive is applied to said closure portion, a message is printed on said opposing surface of said bag adjacent said opening, and said indicator material is applied to said opposing surface of said adhesive, whereby said printing is visible until said bag is properly sealed.

* * * * *